United States Patent [19]

Tateyama

[11] Patent Number: 4,975,692

[45] Date of Patent: Dec. 4, 1990

[54] APPARATUS FOR DRIVING ELECTROLUMINESCENCE PANEL

[75] Inventor: Jiro Tateyama, Yokohama, Japan

[73] Assignee: Canon Kabushiki Kaisha, Tokyo, Japan

[21] Appl. No.: 287,010

[22] Filed: Dec. 21, 1988

[30] Foreign Application Priority Data

| | | | |
|---|---|---|---|
| Dec. 26, 1987 | [JP] | Japan | 62-328431 |
| Nov. 21, 1988 | [JP] | Japan | 63-29354 |
| Nov. 21, 1988 | [JP] | Japan | 63-29355 |

[51] Int. Cl.[5] ..... G09G 3/30

[52] U.S. Cl. ..... 340/781; 340/716; 350/345

[58] Field of Search ..... 340/781, 811, 813, 716; 315/169 B; 350/345

[56] References Cited

U.S. PATENT DOCUMENTS

| | | | |
|---|---|---|---|
| 4,253,097 | 2/1981 | Hochstrate | 340/781 |
| 4,443,741 | 4/1984 | Tanaka et al. | 340/781 |
| 4,500,173 | 2/1985 | Leibowitz et al. | 350/345 |
| 4,562,433 | 12/1985 | Biferno | 340/781 |
| 4,580,877 | 4/1986 | Washo | 350/345 |

*Primary Examiner*—Jeffery A. Brier

*Attorney, Agent, or Firm*—Fitzpatrick, Cella, Harper & Scinto

[57] ABSTRACT

There is provided an apparatus for driving an electroluminescence (EL) panel which is arranged on the back side of the display surface of an LCD and used as a back light thereof. This apparatus comprises: a driver to drive the EL panel of the LCD; a signal generator to generate a plurality of signals having frequencies which are difficult from at least a frequency of a drive signal of the LCD and harmonics of the drive signal; a selector to select one of the signals generated by the generator; a supply circuit to supply an AC voltage having the frequency of the selected signal to the driver as the drive signal of the EL panel; a detector to detect whether the drive signal frequency to the EL panel lies within a frequency range where an interference is exerted on the display surface of the LCD or not; and an adjusting circuit to adjust so that the drive signal frequency is deviated out of the frequency range to exert an influence when the detector detects that the drive signal frequency lies within the frequency range. The driver consists of a self-excited or separately excited inverter. Thus, the luminence deterioration can be minimized and the generation of an interference fringe pattern with the LCD can be suppressed and the EL panel can be driven at a high reliability.

12 Claims, 13 Drawing Sheets

APPARATUS FOR DRIVING ELECTROLUMINESCENCE PANEL

BACKGROUND OF THE INVENTION

1. Field of the Invention

The present invention relates to an apparatus for driving an electroluminescence panel which is located on the back side of a display surface of a liquid crystal display.

2. Related Background Art

In recent years, a liquid crystal display (hereinafter, simply referred to as an LCD) has been used as a display device in word processors, personal computers, and the like.

This is because as compared with a display device of the CRT type, the apparatus can be constructed in a compact size, electric power consumption is small, and driving voltage is low, so that the LCD is suitable to realize a portable apparatus.

On the other hand, since the LCD does not emit the light by itself, there is a problem such that, for instance, it is difficult to confirm the display content under dark circumstances. Therefore, in the case of an electronic apparatus such as a word processor or the like using the LCD as a display device, it is desirable to operate the apparatus at a lighted place.

In recent years, however, there has been developed a system in which a transparent type LCD is used and an illuminating device is provided on the back side, thereby enabling the display content to be also easily confirmed even under the dark place.

In general, as such as illuminating device, an electroluminescence panel (hereinafter, simply referred to as an EL panel) is used to effectively use the characteristic of the LCD.

An AC power source is generally used to drive the EL panel. There is a feature such that the luminance of the EL panel rises with an increase in drive frequency or applied voltage of the EL panel.

On the other hand, a self-excited DC/AC inverter is ordinarily used as an apparatus to drive the EL panel. This is because since the EL lamp as a component element of the EL panel has a structure of a capacitor, a resonance circuit with its capacitive component of the capacitor and the inductive component of the selfexcited inverter is formed.

Since the capacitance of the EL lamp decreases in accordance with the lighting time thereof, the oscillating frequency of the inverter is set to automatically increase with the lighting time.

That is, since impedance of the EL lamp also increases with the lighting time, the output frequency and voltage of the self-excited inverter increase. Thus, the deterioration in luminance of an EL lamp driven by the self-excited inverter may be smaller than that driven by the commercial AC power source whose voltage and frequency are fixed.

FIG. 1 shows an example of the self-excited inverter. FIG. 2A is a curve showing the deterioration in luminance (B) to an AC power source in which a voltage (V) and a frequency (f) are fixed. FIG. 2B is a curve showing an output voltage and a frequency of the self-excited inverter and the deterioration in luminance to them.

As shown in the diagrams, it will be understood that the EL lamp using the self-excited inverter of FIG. 2B is advantageous because the luminance curve B of FIG. 2B indicative of the luminance deterioration is more gentle than that of FIG. 2A, that is, the degree of attenuation is smaller by the amount of increase in drive frequency and voltage in dependence on the lighting time of the EL lamp.

In FIGS. 2A and 2B, the time shown on an axis of abscissa corresponds to a long time and the luminance is not attenuated for a short time, e.g., a few hours.

It has been found that when the EL panel which is driven by such a self-excited DC/AC inverter is located as a back light on the back side of the LCD and used, a fringe pattern is generated on the display screen of the LCD at a certain time point, so that the display content becomes hard to see.

This is because the drive frequency f of the EL panel gradually rises due to the above-described reasons and becomes a frequency near the frequency which is integer times (harmonics) as high as a frame frequency n of the LCD, so that an interference occurs at such a time point.

On the other hand, the luminance deterioration of the EL lamp gradually progresses in dependence on the use time (on the order of hundreds or thousands hours). Therefore, there occurs a problem regarding how to suppress such a luminance deterioration. However, it is the present situation such that a technique to solve such a problem is not established yet.

SUMMARY OF THE INVENTION

It is an object of the present invention to provide an apparatus for driving an electroluminescence panel in which high reliability is obtained and the luminance deterioration can be minimized.

Another object of the invention is to provide an apparatus for driving an electroluminescence panel in which the luminance deterioration of the EL panel can be improved and the generation of an interference fringe pattern with a liquid crystal display can be suppressed.

DETAILED DESCRIPTION OF THE PREFERRED EMBODIMENTS

[FIRST EMBODIMENT]

The first embodiment according to the present invention will be described in detail hereinbelow with reference to the drawings.

<DESCRIPTION OF THE CHARACTERISTIC OF THE EL PANEL >

A self-excited DC/AC inverter is ordinarily used as an apparatus for driving an EL panel.

That is, an EL panel (or EL lamp constructing the EL panel) is a capacitor and the DC/AC inverter is constructed by a resonance circuit consisting of the capacitive component of the capacitor and the inductive component of the inverter. The capacitance of the EL panel gradually decreases in dependence on the use time (on the order of hundreds or thousands hours). At this time, an output frequency of the inverter gradually rises due to the change in charge capacitance and an impedance of the EL panel also increases.

Figure 1:
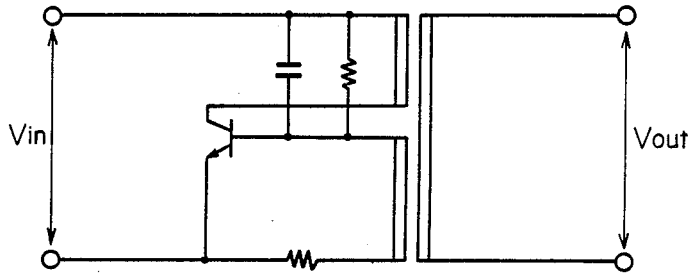
FIG. 1 is a diagram showing an example of a self-excited inverter.
Figure 2A:
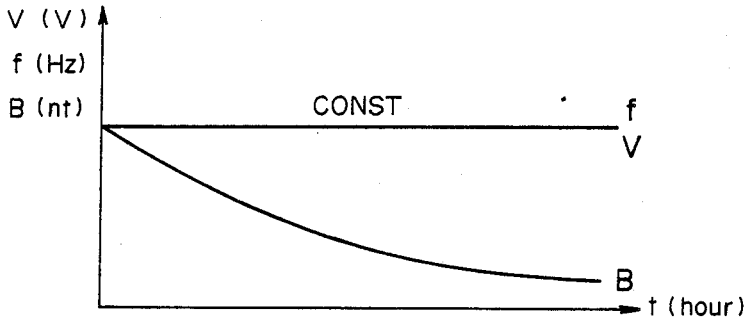
FIG. 2A is a diagram showing a luminance deterioration curve to an AC power source in which a voltage and a frequency are fixed.
Figure 2B:
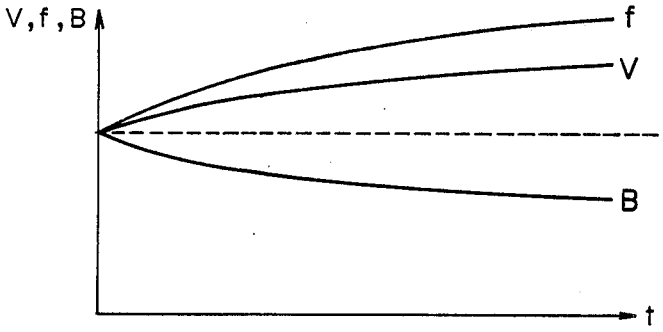
FIG. 2B is a diagram showing an output voltage and a frequency of a self-excited inverter and a luminance deterioration curve to them.

FIG. 2B shows the foregoing changes in frequency, voltage, and luminance which occur for a long time.

Figure 3:
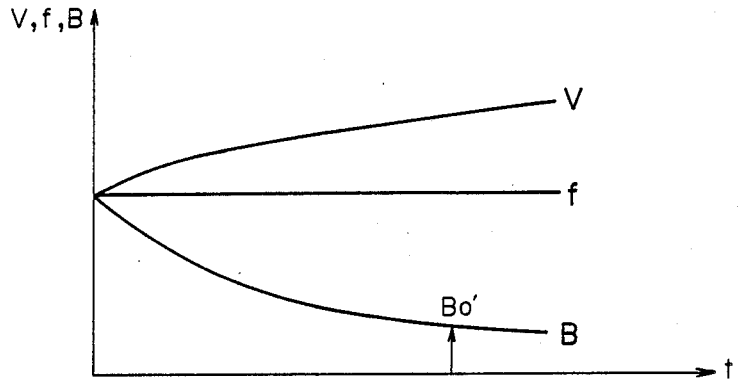
FIG. 3 is a diagram showing an output voltage and a frequency of a separately excited inverter and a luminance deterioration curve to them.

On the other hand, although the output frequency becomes constant in the case of using a separately excited DC/AC inverter, the relations as shown in FIG. 3 are obtained.

<DESCRIPTION OF THE PRINCIPLE TO SUPPRESS THE LUMINANCE DETERIORATION (FIG. 4)>

The principle to suppress the luminance deterioration in the first embodiment will be described hereinbelow in consideration of the characteristic of the EL panel mentioned above.

In the first embodiment, the case of using the separately excited DC/AC inverter will be explained.

As mentioned above, there is the relation as shown in FIG. 3 between the use time of the EL panel and the luminance deterioration curve. However, there is also a fact that the luminance increases by raising the voltage and frequency to drive the EL lamp.

Figure 4:
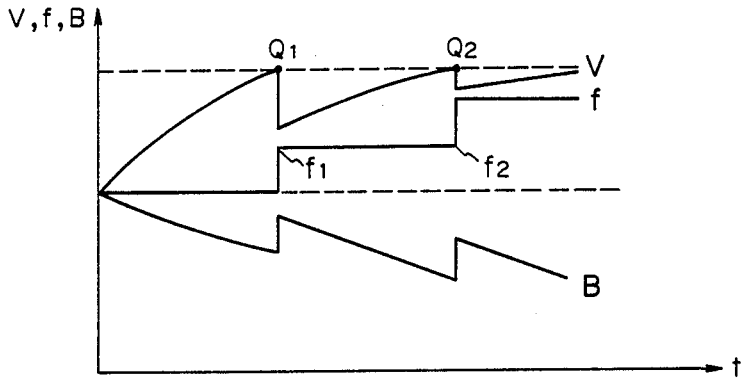
FIG. 4 is a diagram showing the characteristic of an EL panel according to the first embodiment.

In the first embodiment, the relations among the output voltage V, frequency f, and luminance B are set as shown in FIG. 4. That is, when the voltage V reaches a predetermined reference value $V_{sat}$ (points $Q_1$ and $Q_2$ shown in the diagram), the frequency f is raised and the drive voltage V of the EL panel is reduced. At this time, even if the voltage decreases to a certain degree, since the increasing rate of the frequency is high, the luminance B of the EL panel can be raised as shown in the diagram. In other words, the decreasing speed of the luminance B can be made slow.

<DESCRIPTION OF THE SCHEMATIC ARRANGEMENT>

Figure 5:
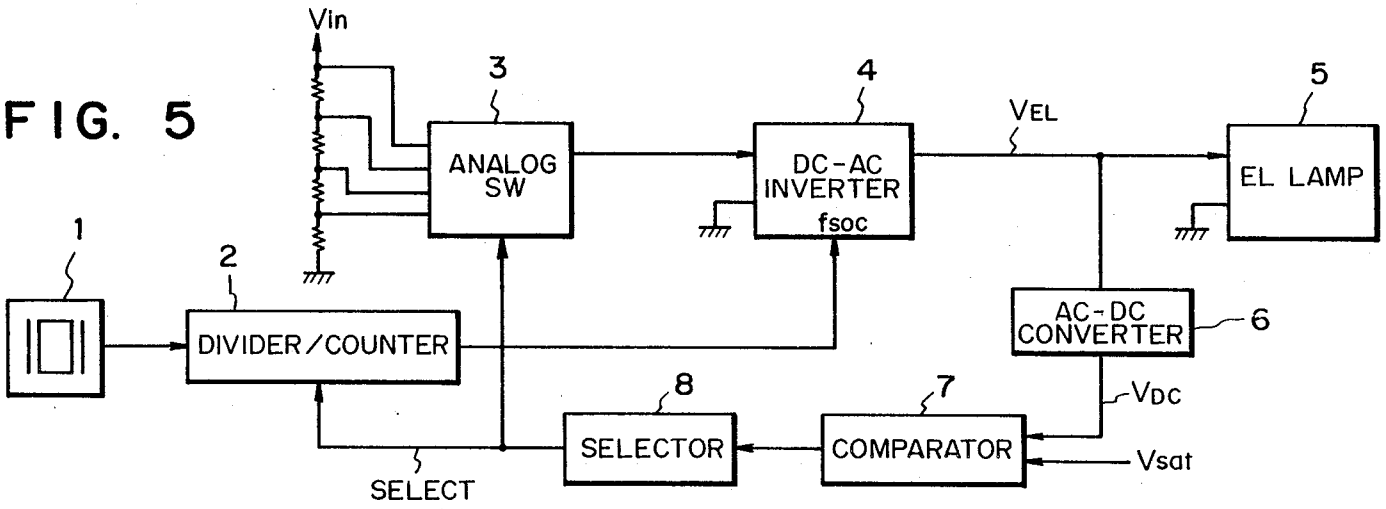
FIG. 5 is a schematic arrangement diagram of an apparatus for driving the EL panel according to the invention.

FIG. 5 shows a schematic arrangement of the display drive apparatus in the first embodiment to accomplish the above-mentioned principle.

In the diagram, reference numeral 1 denotes an oscillator to output a signal of a predetermined frequency. Reference numeral 2 denotes a frequency divider/counter which receives the signal from the oscillator 1 and divides into the signal of an arbitrary frequency. The divider/counter 2 outputs a signal of a frequency based on a selection signal from a selector 8, which will be explained hereinafter. Reference numeral 3 denotes an analog switch to output an arbitrary voltage to a reference voltage $V_{in}$. The analog switch 3 outputs a voltage based on the selection signal from the selector 8. The divider/counter 2 and analog switch 3 in the embodiment are constructed so as to switch into four stages, respectively. Reference numeral 4 denotes a DC/AC inverter for receiving both a clock signal output from the divider/counter 2 and a voltage level signal output from the analog switch 3, for generating an AC voltage $V_{EL}$ of the corresponding frequency and voltage, and for outputting to an EL panel 5. An AC/DC converter 6 converts the AC voltage supplied to the EL panel 5 into the DC voltage. The DC voltage $V_{DC}$ obtained from the AC/DC converter 6 is output to one of the input terminals of a comparator 7. The foregoing voltage $V_{sat}$ is supplied to the other input terminal of the comparator 7. The comparator 7 compares the two input voltages and outputs a "1" level signal when the voltage from the AC/DC converter 6 is larger than the voltage $V_{sat}$ (the comparator 7 outputs a "0" level signal in the other cases). The selector 8 counts the "1" signal and outputs a corresponding signal (two bits). The selector 8 has therein a non-volatile memory to keep the count value even if the power source of the apparatus is turned off.

For example in FIG. 4, the output of the comparator 7 is set to "1" at the time points of $Q_1$, $Q_2$, ... and the frequency is changed to $f_1$, $f_2$, ... each time the "1" signal is received. Thus, the luminance deterioration curve of the EL panel changes as shown in the diagram and the EL panel can be used for a longer time.

Although the foregoing effect can be accomplished by changing the voltage V and frequency f, there occurs a problem regarding to which extent the value of the changed frequency f is set.

This is because when the drive frequency f of the EL panel 5 becomes a value near the frequency which is integer times as high as the drive frequency n of the LCD, an interference occurs and a fringe pattern is generated on the display screen. In other words, the above problem can be solved by setting such that the drive frequency of the EL panel is not located in the hatched regions shown in FIG. 6 by switching the frequency. Therefore, the divider/counter 2 selectively outputs the frequencies $f_1$, $f_2$, $f_3$, ... shown in the diagram on the basis of the selection signal from the selector 8.

In the foregoing first embodiment, the frequency has been switched each time the AC drive voltage of the EL panel 5 has reached the reference voltage $V_{sat}$. However, the invention is not limited to such a construction. Developed embodiments of the first embodiment will now be sequentially explained hereinbelow.

Figure 7:
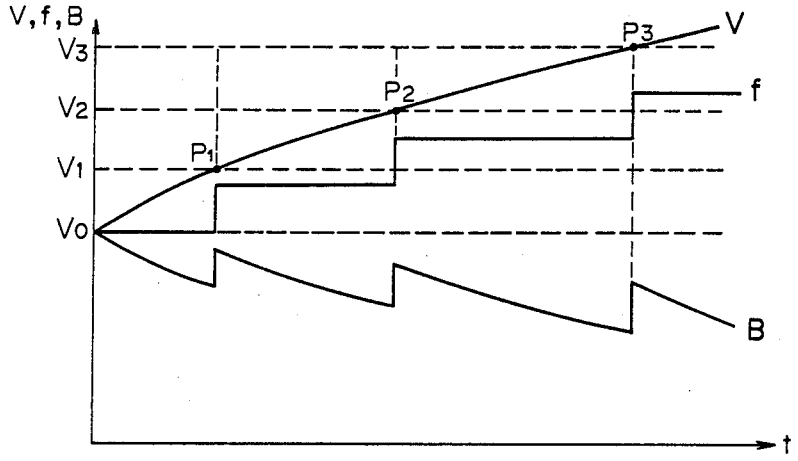
FIGS. 7 to 11 are diagrams showing the characteristic of an EL panel in another embodiment.

FIG. 7 shows an example in which the output frequency f is switched each time the AC output voltage of the inverter 4 rises and becomes the voltage levels at points $P_1$, $P_2$, and $P_3$ (each time the voltage value becomes $V_1$, $V_2$, and $V_3$). In such an example, the speed of the luminance deterioration can be made slow as shown in the diagram. At this time, the generation of a fringe pattern on the display screen can be prevented if the value of the output frequency is selected on the basis of the foregoing principle.

Since the luminance deterioration curve of the EL panel can also predicted, the frequency can be be switched, for instance, each time a predetermined time has elapsed (on the order of hundreds or thousands of hours, as mentioned above). This state is shown in FIG. 8.

Figure 8:
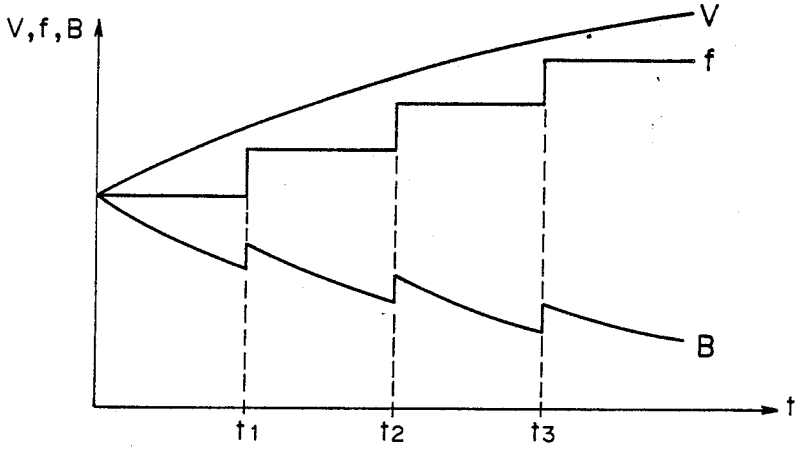
Figure 9:
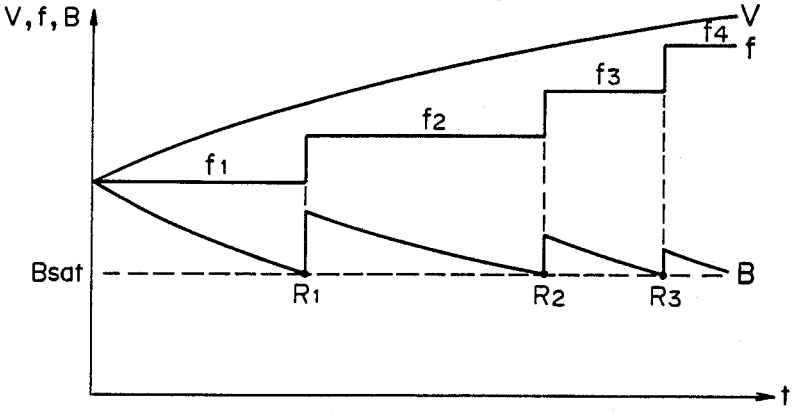

Further, the principle in FIG. 8 is further advanced and, for instance, as shown in FIG. 9, it is also possible to construct such that a sensor to detect the luminance of the EL panel is provided and the frequency is switched on the basis of an output voltage level from the sensor.

Figure 10:
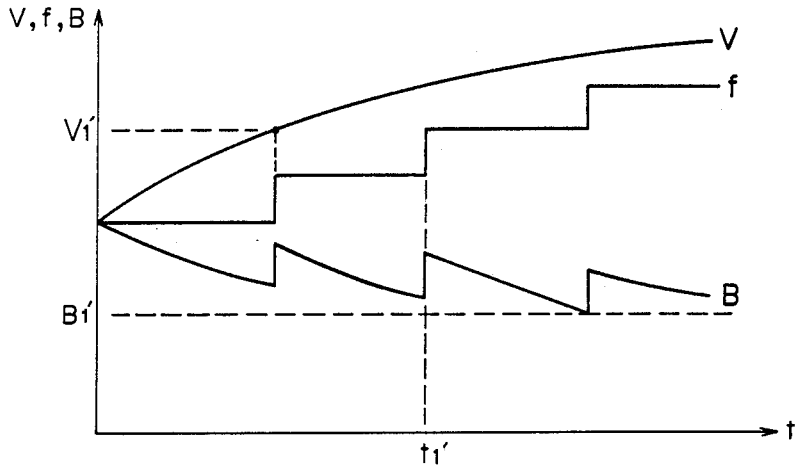

As shown in FIG. 10, it is also possible to construct such that the use time t and luminance B are detected and the AC voltage value V of the inverter is used as a parameter, and when any one of the use time t, luminance B, and AC voltage value V coincides with [$t_1'$, $B_1'$, $V_1'$], the frequency of the AC voltage which is output to the EL panel is switched.

In the first embodiment, the case of using the separately excited DC/AC inverter has been described. However, since the foregoing effect can be also accomplished by using the self-excited DC/AC inverter, such an example will now be described hereinbelow as the second embodiment.

[SECOND EMBODIMENT]

The second embodiment according to the invention will be described in detail hereinbelow with reference to the drawings.

<DESCRIPTION OF THE CONSTRUCTION OF THE APPARATUS>

Figure 12:
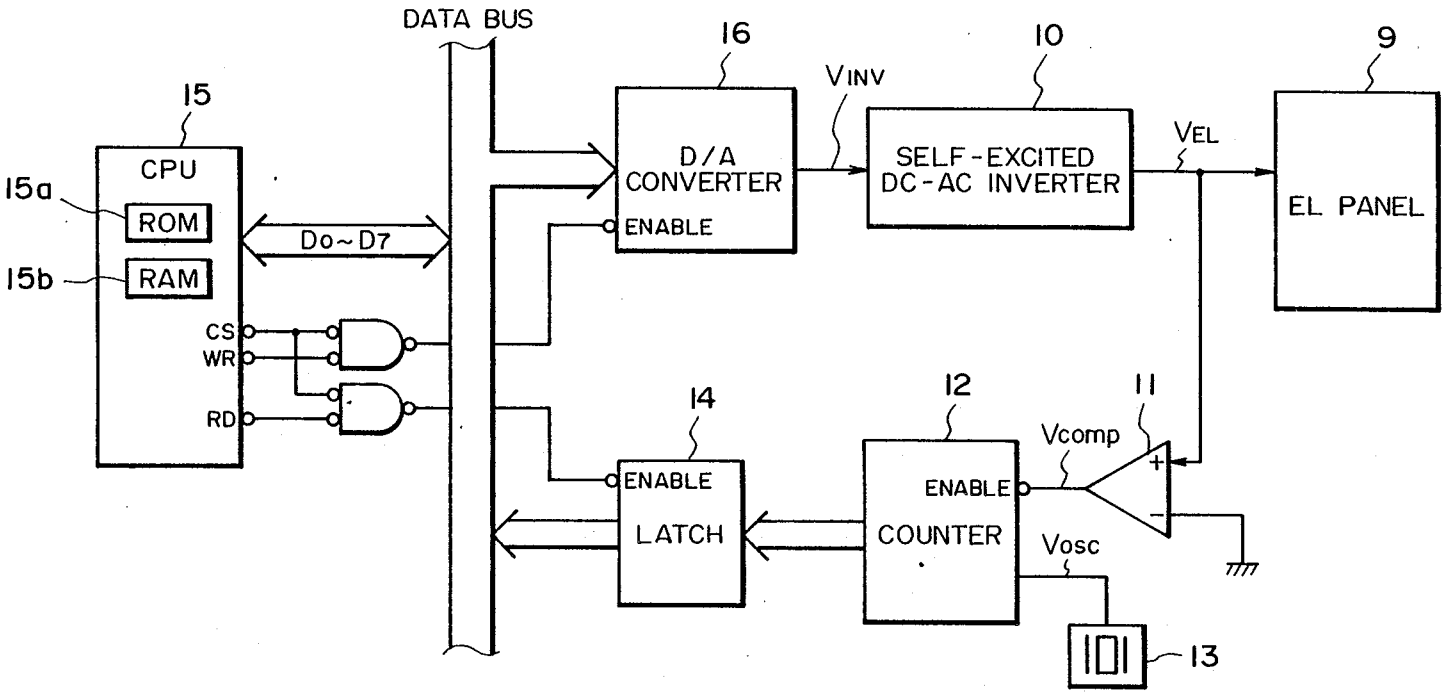
FIG. 12 is a block arrangement diagram of an apparatus for driving an EL panel in the second embodiment.

FIG. 12 shows a block arrangement diagram of an apparatus for driving an electroluminescence panel (hereinafter, simply referred to as an EL panel) in the second embodiment.

Reference numeral 9 denotes an EL panel for emitting the light by an AC voltage $V_{EL}$ from a self-excited DC/AC inverter 10. The AC voltage $V_{EL}$ is applied to a comparator 11 and converted into a logic level signal $V_{COMP}$ of "0" or "1" level. The signal $V_{COMP}$ is connected to an enable terminal of a counter 12. When the signal $V_{COMP}$ is at the "0" level, the counter 12 counts reference clocks $V_{OSC}$ of an oscillator 13. A count value of the counter 12 is latched into a latch 14. A CPU 15 to control the whole apparatus can know the count value by reading the content of the latch 14.

Figure 13:
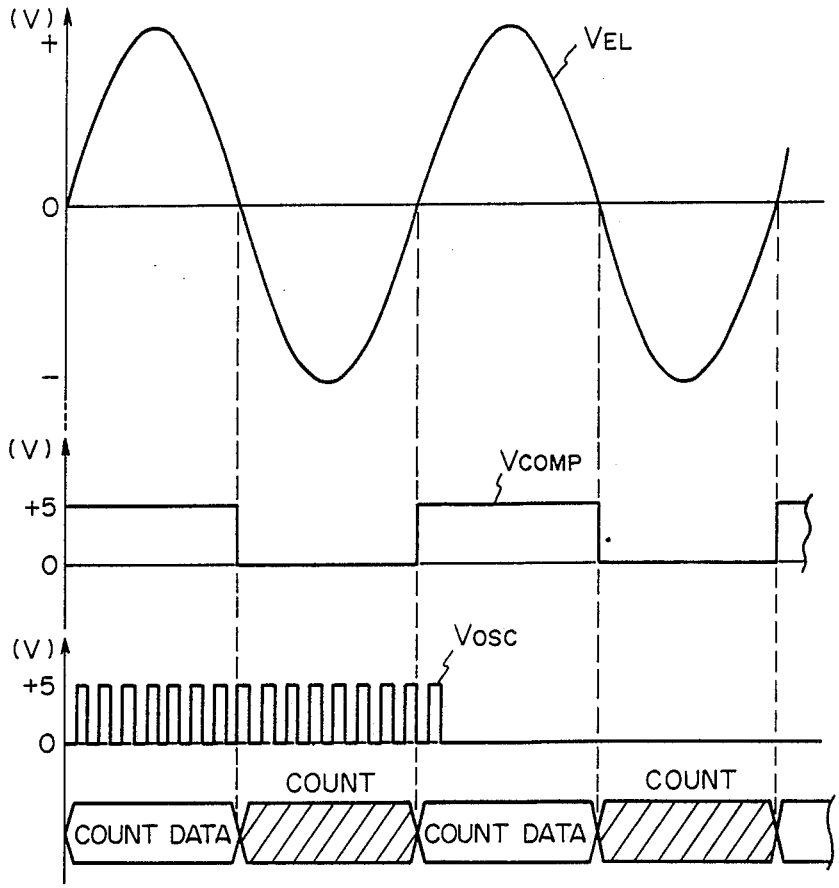
FIG. 13 is a diagram for explaining the principle of the frequency detection in the second embodiment.

The principle will now be described with reference to FIG. 13.

The AC drive voltage $V_{EL}$ to the EL panel 9 is oscillating as shown in the diagram. The AC signal is converted into the logic level signal of "0" or "1" as $V_{COMP}$ by the comparator 11. When the signal $V_{COMP}$ is at the "0" level, the counter 12 counts the clocks $V_{OSC}$ which are output from the oscillator 13. When the $V_{COMP}$ is set to "1", the content of the latch 14 is read, so that the time when the $V_{EL}$ is set to a negative value once and the frequency of the $V_{EL}$ can be detected.

A D/A converter 16 converts the digital data output from the CPU 15 into the corresponding analog signal and outputs as a DC drive voltage $V_{INV}$ of the self-excited DC/AC inverter 10.

A program regarding a flowchart shown in FIG. 15 which will be explained hereinafter, is stored in an ROM 15*a* in the CPU 15. An RAM 15*b* is used as a work area.

<DESCRIPTION OF THE PRINCIPLE AND OPERATION>

The principle and operation of the second embodiment with the foregoing structure will be described hereinbelow.

As already explained above, the self-excited DC/AC inverter 10 has the characteristic such that when the input voltage rises, both of the output voltage (namely, $V_{EL}$) and the frequency also increase.

Figure 11:
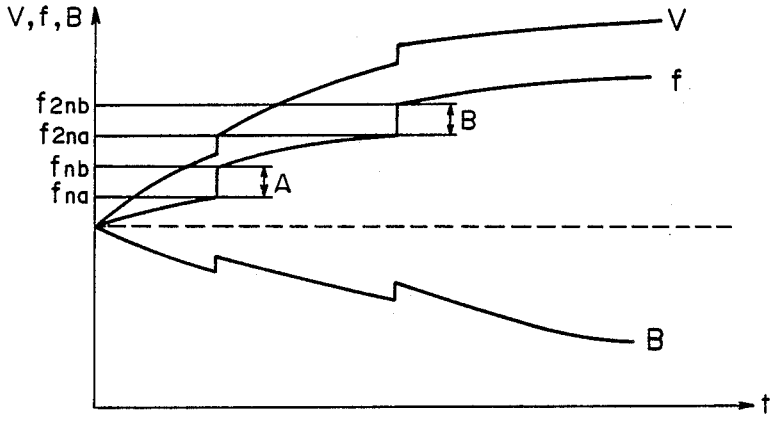

In the second embodiment, as shown in FIG. 11 and explained above, the frequency of the AC drive voltage $V_{EL}$ of the EL panel 9 is detected by the count value of the latch 14, and when the frequency is determined to be $f_{na}$ or $f_{2na}$ shown in FIG. 11, the data which is output to the D/A converter 16 is updated to a larger value so as to raise the frequency to a frequency $f_{nb}$ or $f_{2nb}$ which is higher by one level. Due to this, the AC drive voltage $V_{EL}$ to the EL panel 9 is increased and the frequency is raised, so that the deterioration speed of the luminance deterioration curve B can be reduced.

In the second embodiment, the input voltage $V_{INV}$ to the inverter 10 is not merely raised, but even in the process to gradually increase the input voltage $V_{INV}$, the count value in the latch 14 is read and the frequency of the AC drive voltage $V_{EL}$ to the EL panel 9 at that time is detected. The frequency is raised to a value so as not to generate an interference fringe pattern onto the display surface of the LCD located on the front surface of the EL panel 9 in the second embodiment.

Figure 6:
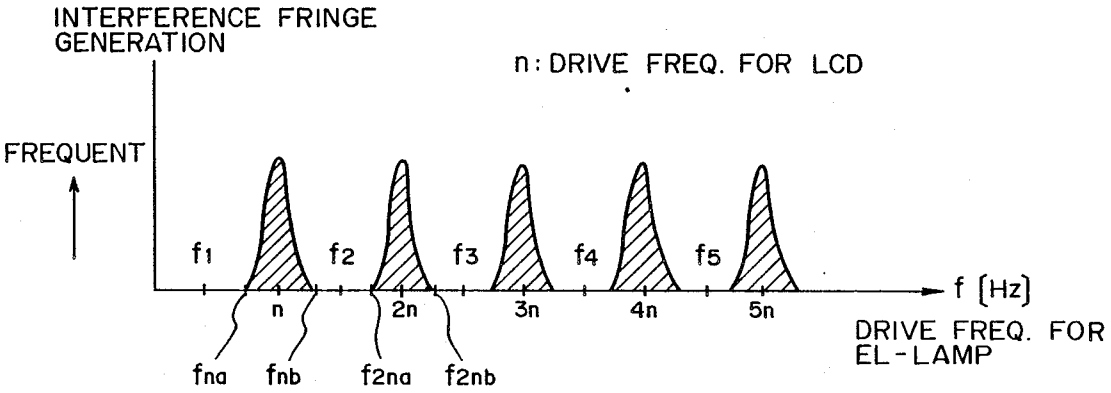
FIG. 6 is a diagram showing an interference between a display section and a drive frequency of a back illuminating section and an intensity of a fringe pattern.

FIG. 6 shows the drive frequency for the EL panel 9 and the interference fringe pattern generation. In this case, the drive frequency for the LCD display device is set to n.

As shown in FIG. 6, when the frequency n is set as a reference frequency and if the frequency of the AC drive voltage $V_{EL}$ for the EL panel 9 lies within predetermined regions (regions A and B shown in FIG. 11) before and after the harmonics (frequencies which are integer times as high as the reference frequency n) of the frequency n, an interference fringe pattern is generated as mentioned above.

Therefore, when it is detected that the frequency f of the AC voltage $V_{EL}$ has reached, for instance, $f_{na}$, it is sufficient to update the data which is output to the D/A converter 16 in order to raise the frequency to $f_{nb}$ shown in the diagram. Such processes are executed in the second embodiment.

Figure 14:
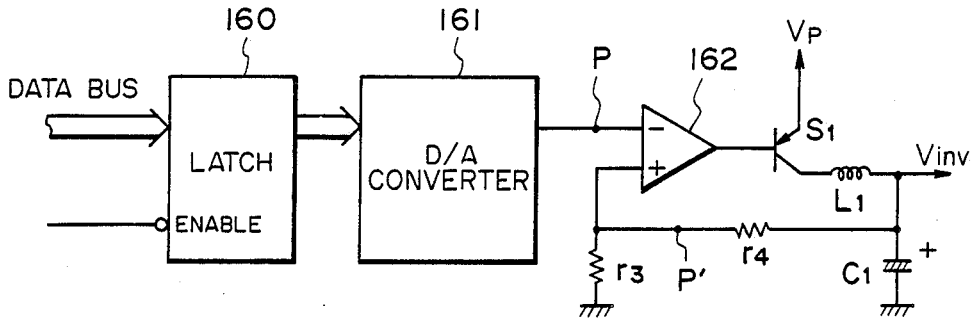
FIG. 14 is a detailed block diagram of a D/A converter 16 in the second embodiment.

An example of a structure of the D/A converter 16 in the second embodiment is shown in FIG. 14 and its operation will now be described hereinbelow.

The data output from the CPU 15 is latched into a latch 160. The voltage corresponding to the latched value is formed by a D/A converter 161. The voltage is used as a reference voltage to determine the drive voltage of the self-excited DC/AC inverter 10. $V_P$ denotes a power source voltage of the apparatus. Since $V_{INV}$ is at the "0" level when the $V_P$ is applied, the potential at point P' as the divided voltage is also at the "0" level. On the other hand, since the voltage at point P is higher than the "0" level, an output of a comparator 162 is set to "0". Therefore, since the potential difference between $V_P$ and the voltage of the output signal of the comparator 162 is large, a transistor $S_1$ is turned on. A current flows to $V_{INV}$ through a coil $L_1$ and the potential of the $V_{INV}$ rises. When the $V_{INV}$ increases in this manner, the divided voltage at point P' obtained through resistors $r_3$ and $r_4$ also rises to a value larger than the voltage at point P. Since the output signal of the comparator 162 is set to "1", the transistor $S_1$ is turned off, so that the $V_{INV}$ contrarily gradually decreases. When the voltage at point P' again becomes lower than that at point P, the $V_{INV}$ is increased. The $V_{INV}$ formed by repeating the above operations is supplied as an input voltage to the self-excited DC/AC inverter 10.

In FIG. 14, $L_1$ and $C_1$ denote elements to smooth the $V_{INV}$.

<DESCRIPTION OF THE CONTENT OF PROCESSES>

The above-described processes are executed by the CPU 6. The operation processing procedure of the CPU 15 is summarized as shown in FIG. 15.

In the first step S1, the count value of the counter 12 is read out by the latch 14 and the frequency of the drive voltage to the EL panel 9 at that time is detected.

In the next step S2, a check is made to see if it is necessary to change the frequency or not. Practically speaking, such a discrimination is performed by checking whether the detection frequency f falls within ranges from $f_{na}$ to $f_{nb}$, from $f_{2na}$ to $f_{2nb}$, ... in FIG. 6 or not.

If the detection frequency f is out of those ranges, it is decided that there is no need to change the frequency f, and the processing routine is finished. On the contrary, if it is determined that the frequency needs to be changed, step S3 follows and the data output to the D/A converter 16 is changed to a larger value, thereby increasing the voltage of the drive voltage $V_{EL}$ to be applied to the EL panel 9 and also raising the drive frequency.

After that, the processes in step S1 and subsequent steps are repeated until the detection frequency reaches the region where no interference fringe pattern is generated.

No problem occurs since the above loop process is instantaneously executed However, if an amount of data which should be output to the D/A converter 16 is previously known, the foregoing loop processes can be completed by a single loop by outputting the data to the D/A converter 16. In such a case, it is sufficient that the data which is output to the D/A converter 16 is stored into the ROM 15*a*.

As described above, according to the embodiment, the luminance deterioration of the electroluminescence panel can be prevented and the generation of an interference fringe with the LCD locating, on the front surface of the EL panel can also be prevented.

On the other hand, for instance, a manual switch or the like is provided and the applied voltage to the EL panel can also be arbitrarily changed (therefore, the frequency is also changed). Thus, for instance, in the case where the present apparatus is installed in a word processor, if it is used at a light or dark place or the like, the applied voltage to the EL panel can be properly adjusted Even in such a case, it is desirable to interpose the CPU 15 between the manual switch and the D/A converter 16. This is because as already described above, the CPU 15 always detects the frequency of the drive voltage to the EL panel and controls the frequency change, so that the luminance can be changed in a range excluding the ranges of the occurrence of an interference fringe.

On the other hand, when such an idea is further advanced, it is also possible to construct in a manner such that by providing means for detecting a light amount of the external light, the drive voltage is changed on the basis of the detected light amount, for instance, the drive voltage is changed to a higher voltage if the apparatus is installed at a dark place and, contrarily, it is changed to a lower voltage if the apparatus is installed at a light place.

[THIRD EMBODIMEBNT]

The third embodiment according to the invention will now be described in detail hereinbelow with reference to the drawings. In the third embodiment, the case of using the separately excited DC/AC inverter will be explained.

<DESCRIPTION OF THE ARRANGEMENT OF THE APPARATUS>

Figure 16:
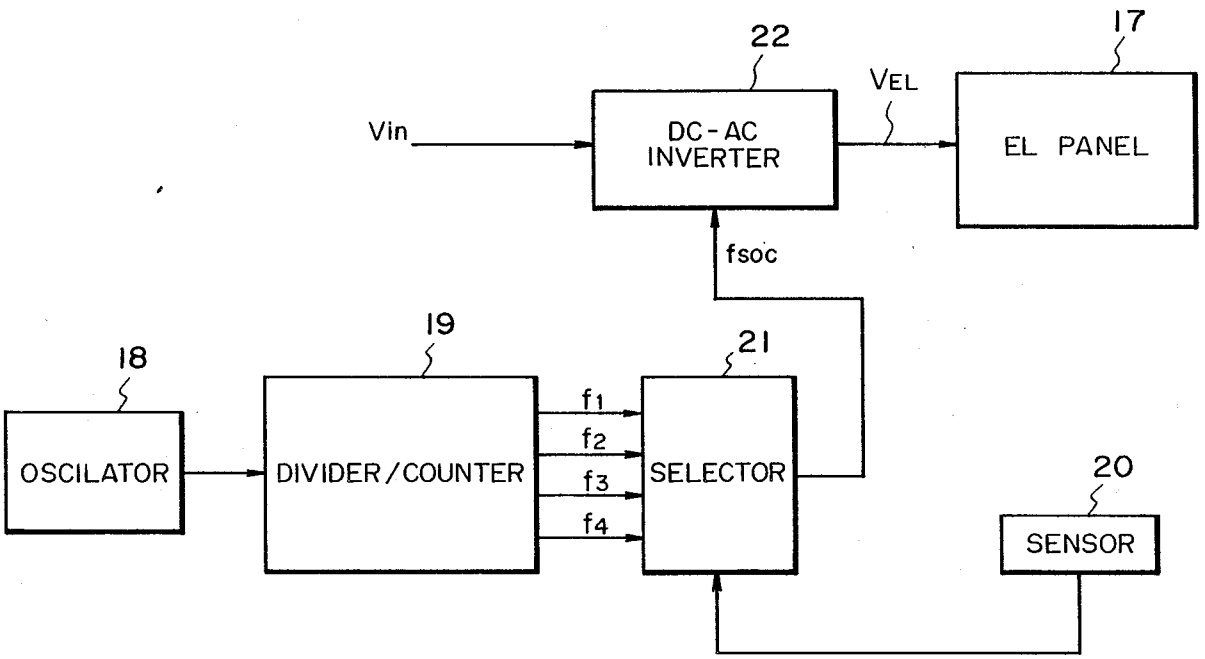
FIG. 16 is a block arrangement diagram of an apparatus for driving an EL panel in the third embodiment.

FIG. 16 is a block arrangement diagram of an apparatus for driving an electroluminescence panel (hereinafter, simply referred to as an EL panel) in the third embodiment.

In the diagram, an oscillator 18 oscillates at least at an enough high frequency (generates an original oscillation signal) than a drive frequency of an actual EL panel 17. Reference numeral 19 denotes a frequency divider/-counter for receiving a signal of a reference frequency supplied from the oscillator 18 and generating signals of frequencies $f_1$ to $f_4$. A sensor 20 detects the luminance of the EL panel 17 and generates a voltage signal at the level corresponding to the luminance. A selector 21 selects one of the frequencies $f_1$ to $f_4$ output from the divider/counter 19 on the basis of the luminance of the EL panel 17 detected by the sensor 20 and outputs as an oscillation signal $f_{soc}$ of the EL panel 17. A DC/AC inverter 22 oscillates an input voltage $V_{in}$ at the frequency of the oscillation signal $f_{soc}$ output from the selector 21 and supplies as an AC drive voltage VEL to the EL panel 17.

<DESCRIPTION OF THE PRINCIPLE AND OPERATION>

The principle and operation of the third embodiment in the foregoing construction will be described hereinbelow.

As already described above, the luminance increases by raising the drive frequency for the EL panel 17.

In the third embodiment, as shown in FIG. 9, when the luminance of the EL panel 17 which is detected by the sensor 20 becomes a predetermined value $B_{sat}$, the oscillation signal to be supplied to the DC/AC inverter is switched to the signal having a frequency which is higher by one level (for instance, $f_1 \rightarrow f_2$; $f_2 \rightarrow f_3$; $f_3 \rightarrow f_4$;...).

The relations among the frequencies $f_1$ to $f_4$ to the signal which is output from the divider/counter 19 and the drive frequency n of the LCD device (not shown) locating on the front surface of the EL panel 17 are set as shown in FIG. 6. That is, when the drive frequency for the EL panel is set to a value near the frequency which is integer times as high as the drive frequency n of the LCD device, an interference fringe pattern is frequently generated as shown in the diagram. Therefore, the frequencies $f_1$ to $f_4$ to determine the drive frequency of the EL panel 17 are set to the frequencies at the centers in the ranges where an interference fringe in each range is not generated. The frequencies $f_1$ to $f_4$ are determined by the following equations.

$$f_1=(n+2n)/2=1.5n$$

$$f_2=(2n+3n)/2=2.5n$$

$$f_3=(3n+4n)/2=3.5n$$

$$f_4=(4n+5n)/2=4.5n$$

For instance, when attention is paid to $f_1$, it is sufficient that $f_1$ is set to a frequency in a range between the frequency $f_{nb}$ at which an interference fringe is generated at frequencies of $f_{nb}$ or less and the frequency $f_{2na}$ at which an interference fringe is generated at the frequencies of $f_{2na}$ or higher. Therefore, the frequency $f_1$ is not limited to the frequency of 1.5n.

The signals of the frequencies 2n, 3n, ... are generally called harmonics for the signal of frequency n. 2n denotes the primary harmonic and 3n indicates the secondary harmonic.

When the luminance of the EL panel 17 detected by the sensor 20 is deteriorated until the preset value $B_{sat}$, for instance, by changing the drive frequency $f_1$ to $f_2$, no interference fringe is generated on the LCD device and the luminance deterioration as a back light can be minimized.

Figure 17:
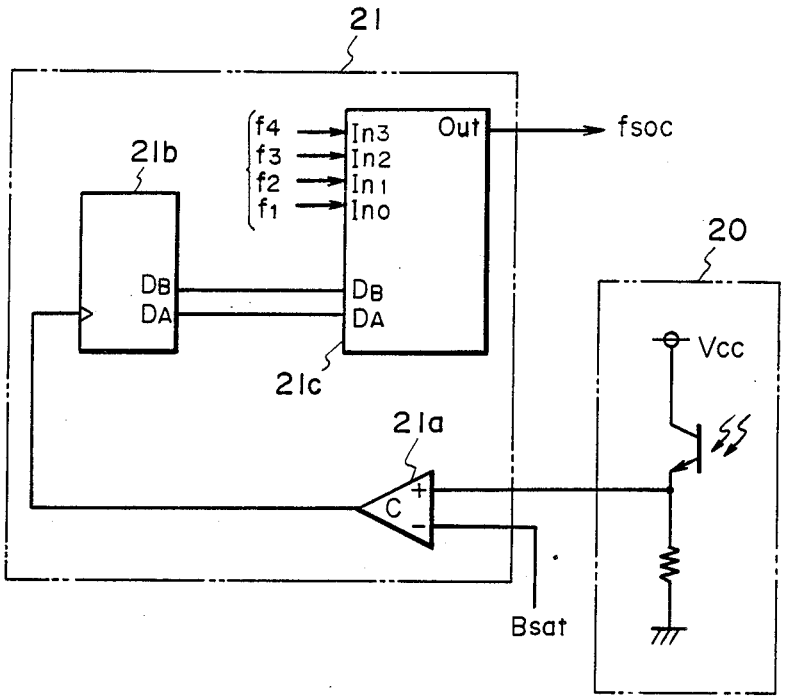
FIG. 17 is a diagram showing a circuit arrangement according to the frequency switching in the third embodiment.

The practical operation will now be described with respect to the sensor 20 and selector 21 shown in FIG. 17.

The voltage level signal from the sensor 20 corresponding to the luminance of the EL panel 17 is supplied to one input terminal of a comparator **21*a* provided in the selector 21. The voltage signal of the level corresponding to the luminance $B_{sat}$ as a reference when the frequency is updated is supplied to the other input terminal of the comparator 21*a*. A "1" level signal is output as a logic signal from the comparator 21*a*. When the luminance of the EL panel 17 reaches $B_{sat}$, the comparator 21*a* outputs a "0" level signal. A counter 21*b* counts up synchronously with the trailing edge of the output signal of the comparator 21*a*. A count value of the counter 21*b* is output as a selection signal of two bits to a selector 21*c*. The selector 21*c*** selects one of the frequencies $f_1$ to $f_4$ in accordance with the state of the 2-bit signal in accordance with the order of $f_1 \rightarrow f_2 \rightarrow f_3 \rightarrow f_4$.

In the third embodiment, when the luminance of the EL panel 17 is attenuated to the preset value $B_{sat}$, the EL panel is driven at the frequency which is higher by one level. However, the invention is not limited to such a method.

Figure 18:
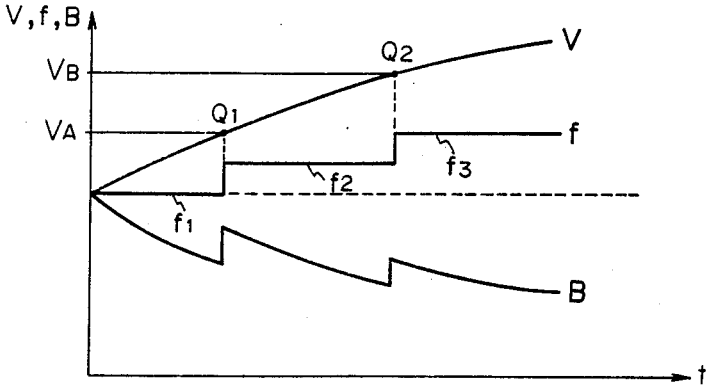
FIG. 18 is a diagram showing changes in frequency of a drive signal to the EL panel and in luminance in the third, embodiment.

For instance, as shown in FIG. 18, it is also possible to construct such that as the drive voltage which is output from the DC/AC inverter rises, the oscillation signal f is updated at the time points when the voltage reaches point $Q_1$ (voltage $V_A$), point $Q_2$ ($V_B$), ...

Figure 19:
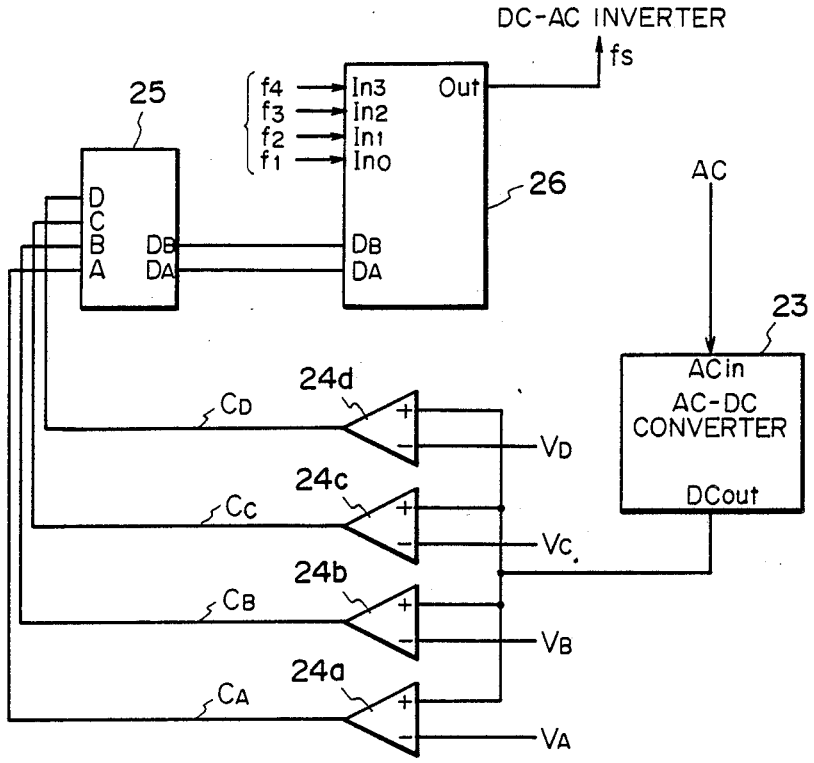
FIG. 19 is a diagram showing a circuit arrangement according to the frequency switching in a developed modification of the third embodiment.

When explaining a circuit shown in FIG. 19, as an example, a drive power source which is supplied from the DC/AC inverter 22 to the EL panel 17 is converted into the DC voltage signal through an AC/DC converter 23 shown in the diagram. The converted voltage signal is supplied to one input terminal of each of comparators **24*a* to 24*d* to which voltages $V_A$ to $V_D$ at the switching points $Q_1$, $Q_2$, ... are applied as threshold values, respectively. Therefore, data $C_A$ to $C_D$ each of which indicates in which range the level of the drive voltage of the EL panel 17 at that time point lies are output from the comparators 24*a* to 24*d*, respectively. An encoder 25 receives the data $C_A$ to $C_D$ and produces a selection signal of two bits and outputs to a selector 26. In a manner similar to the selector 21*c* shown in the foregoing embodiment, the selector 26 selects one of the signals having the frequencies $f_1$ to $f_4$ on the basis of the input 2-bit selection signal and feeds back as the oscillation signal $f_{soc}$ to the DC/AC inverter 22**.

In such a case, in a manner similar to the foregoing embodiment, the four signals which are supplied to the selector 26 have the frequencies so as not to cause an interference.

In this manner, the effect similar to that in the third embodiment can be accomplished.

On the other hand, since the aging change of the luminance deterioration of the EL panel 17 can be predicted to a certain extent, for instance, when the lighting time near the time when the luminance deteriorates to $B_{sat}$ has come, the frequency of the drive signal of the EL panel 17 can also be switched.

Figure 20:
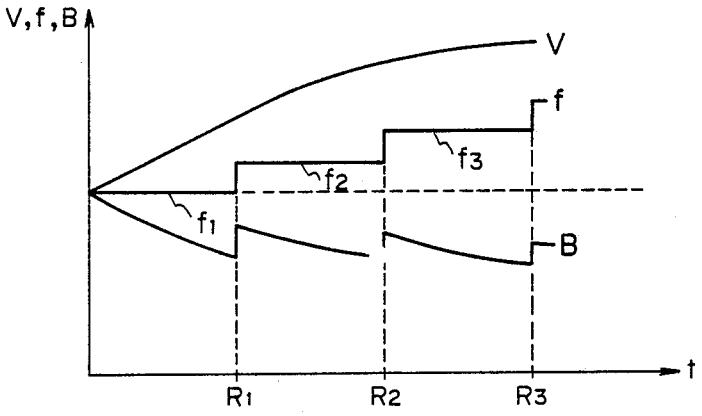
FIG. 20 is a diagram showing changes in frequency of a drive signal to the EL panel and in luminance in the developed modification of the third embodiment.

Practically speaking, as shown in FIG. 20, when the elapsed time has reached $R_1$, $R_2$, and $R_3$, the signal having the frequency which is higher by one level is supplied as the oscillation signal $f_{sat}$ to the DC/AC inverter 22. Although not shown in particular, the apparatus structure in such a case can be easily accomplished by comprising: a timer to continuously measure the lighting time of the EL panel 17; registers to keep the elapsed times $R_1$, $R_2$, and $R_3$ which were measured; comparators to compare the time measured by the timer with the data in the registers; and the like.

The above embodiment has been described with respect to the case of switching only the frequency of the drive voltage of the EL panel 17. However, the input voltage $V_{in}$ of the DC/AC inverter 22 is also raised, so that the AC output voltage of the inverter can also be increased.

Figure 21A:
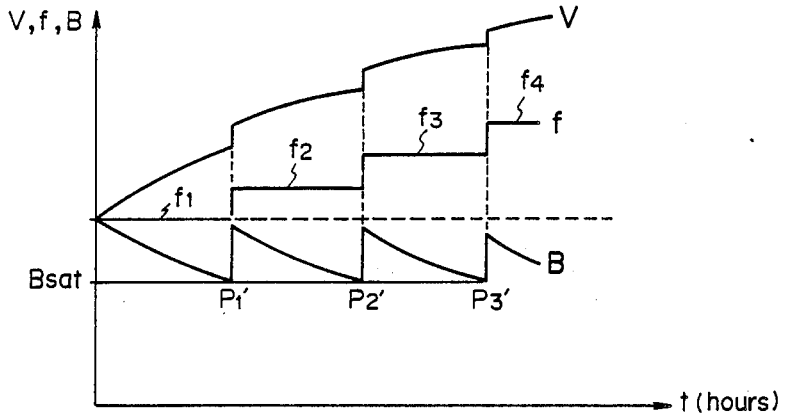
FIGS. 21A to 21C are diagrams showing changes in frequency of a drive signal to the EL panel and in luminance in developed modifications of the third embodiment, respectively.
Figure 21B:
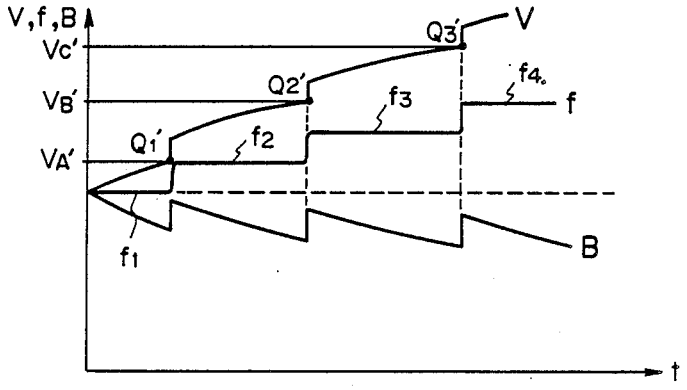
Figure 21C:
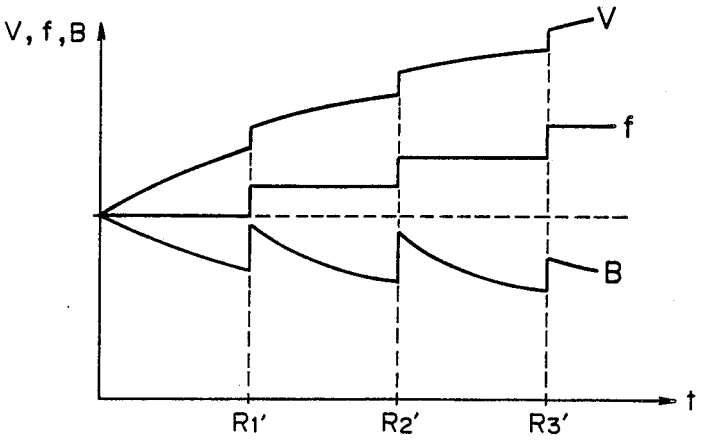

At this time, in order to obtain the switching timing, the foregoing light emission luminance, output drive voltage to the EL panel, drive time of the EL panel, etc. can be considered. FIGS. 21A to 21C show changes in luminance deterioration for a long time in the case where the drive voltage and frequency are updated on the basis of them. When comparing with the corresponding graphs in FIGS. 9, 18, and 20, it will be understood that the luminance deterioration curves in the fourth embodiment are improved.

The input voltage $V_{in}$ to the inverter has been increased step by step. However, it can also be continuously increased.

Further, for instance, it is also considered that the user can arbitrarily change and set the section of the sensor 20 in the third embodiment. That is, the frequency of the drive voltage or the voltage level to the EL panel 17 is adjusted by the user.

Figure 22:
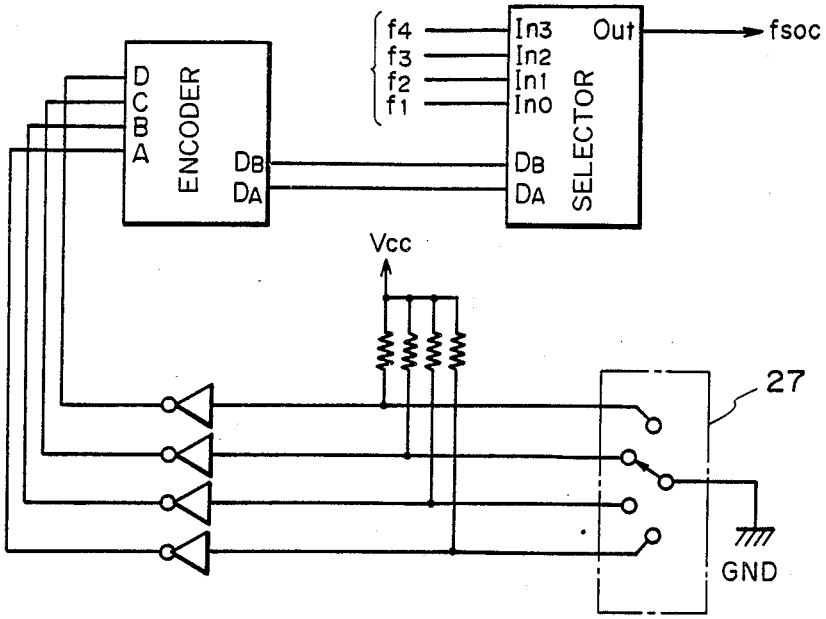
FIG. 22 is a diagram showing an arrangement having a switch to set a frequency of a drive signal to the EL panel.
Figure 23:
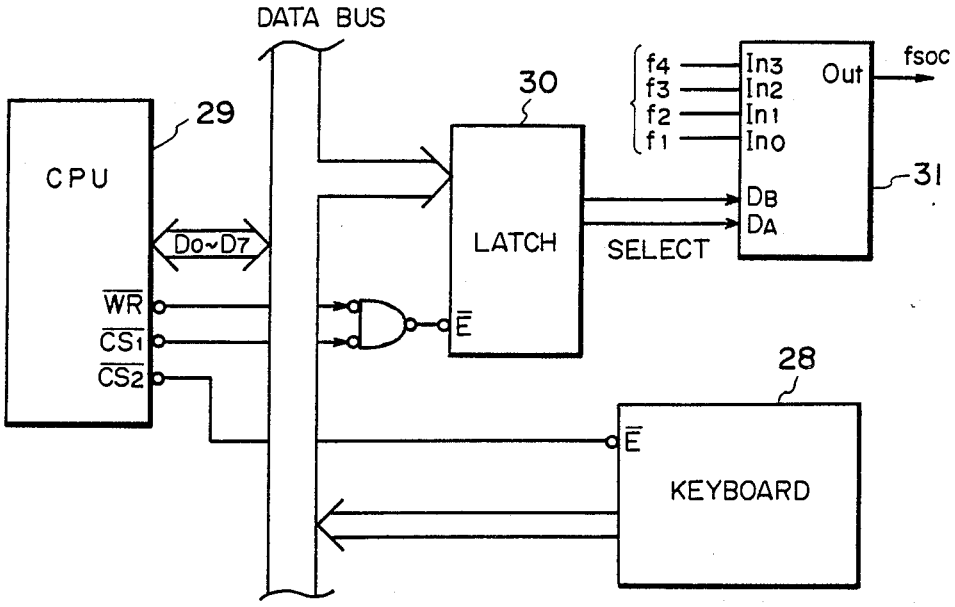
FIG. 23 is a diagram using a keyboard to set a frequency of a drive signal to the EL panel.

In such a case, as a setting method by the user, as shown in FIG. 22, the luminance can be switched by operating a switch 27. On the other hand, if the EL panel 17 is installed to an apparatus such as a word processor or the like having a keyboard, as shown in FIG. 23, the set data is input by a keyboard 28, a CPU 29 allows a latch 30 to latch data to select one oscillation signal on the basis of the depression of a set key, and the one signal is selected by a selector 31.

With such a construction, the luminance deterioration by the lighting time of the EL panel can be adjusted by the user. Consequently, for instance, the luminance can be arbitrarily adjusted in accordance with an influence by the external light or ambient temperature.

As described above, according to the embodiment, the luminance deterioration of the electroluminescence panel is prevented and the EL panel can be used for a long time and the generation of an interference fringe with the LCD device locating on the front surface can be prevented.

On the other hand, the luminance can be efficiently corrected by gradually switching the frequency of the drive voltage applied to the EL panel to a higher frequency.

In addition, by arbitrarily selecting the frequency of the applied voltage, for instance, the luminance can be arbitrarily adjusted in accordance with the influence of the external light or ambient temperature.

What is claimed is:

1. An apparatus for driving an electroluminescence panel which is used as a back light of a liquid crystal display, comprising:

drive means for driving the electroluminescence panel of the liquid crystal display;

signal generating means for generating a plurality of signals which are different in frequency from at least a drive signal of the liquid crystal display and harmonics thereof; and selecting means for selecting one of the signals generated by said signal generating means, wherein said drive means generates an AC voltage having the same frequency as the one signal selected by said selecting means and supplies the AC voltage to the electroluminescence panel as a drive signal thereof.

2. An apparatus according to claim 1, wherein said drive means is a self-excited inverter.

3. An apparatus according to claim 1, wherein said drive means is a separately excited inverter.

4. An apparatus according to claim 1, further comprising:

detecting means for detecting whether the drive signal frequency to the electroluminescence panel lies within a frequency range where an interference is exerted on a display surface of said liquid crystal display or not; and adjusting means for adjusting so that the drive signal frequency is deviated out of said frequency range where an interference is exerted when said detecting means detects that the drive signal frequency lies within said frequency range.

5. An apparatus according to claim 1, wherein said selecting means is switching means which, can manually arbitrarily select one of the signals generated by said signal generating means.

6. An apparatus for driving an electroluminescence panel which is used as a back light of a liquid crystal display, comprising:

a drive power source to supply an AC drive signal to said electroluminescence panel;

detecting means for detecting whether a drive power source frequency to the electroluminescence panel lies within a frequency range where an interference is exerted on a display surface of the liquid crystal display or not; and adjusting means for adjusting so that the drive power source frequency is deviated out of said frequency range where an interference is exerted when the detecting means detects that the drive power source frequency lies within the frequency range to exert an interference.

7. An apparatus according to claim 6, wherein said electroluminescence panel is driven by a self-excited DC/AC inverter, and said adjusting means adjusts the drive power source frequency by adjusting an input voltage to said self-excited DC/AC inverter.

8. An apparatus for driving an electroluminescence panel which is used as a back light of a liquid crystal display, comprising:

drive means for driving the electroluminescence panel of the liquid crystal display;

signal generating means for generating a plurality of signals which are different in frequency from at least a drive signal of the liquid crystal display and harmonics thereof;

luminance detecting means for detecting a luminance of the electroluminescence panel; and selecting means for selecting one of the signals generated by said signal generating means in accordance with the luminance of the electroluminescence panel detected by said luminance detecting means, wherein said drive means generates an AC voltage having the same frequency as the one signal selected by said selecting means and supplies the AC voltage to the electroluminescence panel as a drive signal thereof.

9. An apparatus according to claim 8, wherein said drive means is a self-excited inverter.

10. An apparatus according to claim 8, wherein said drive means is a separately excited inverter.

11. An apparatus according to claim 8, further comprising:

detecting means for detecting whether the drive signal frequency to the electroluminescence panel lies within a frequency range where an interference is exerted on a display surface of the liquid crystal display or not; and adjusting means for adjusting the drive signal frequency so as to be deviated out of the frequency range to exert an interference when the detecting means detects that the drive signal frequency lies within said frequency range.

12. An apparatus according to claim 11, wherein said adjusting means is switching means which can manually finely adjust the drive signal frequency.

* * * * *

UNITED STATES PATENT AND TRADEMARK OFFICE

CERTIFICATE OF CORRECTION

PATENT NO. : 4,975,692

DATED : December 4, 1990

INVENTOR(S) : JIRO TATEYAMA

It is certified that error appears in the above-identified patent and that said Letters Patent is hereby corrected as shown below:

ON TITLE PAGE:

AT [30] Foreign Application Priority Data

"Nov. 21, 1988 [JP] Japan.....63-29354
Nov. 21, 1988 [JP] Japan.....63-29355"
should read
--Nov. 21, 1988 [JP] Japan.....63-292354
Nov. 21, 1988 [JP] Japan.....63-292355--.

AT [57] ABSTRACT

Line 1, "There is provided an" should read --An--.
Line 7, "difficult" should read --different--.

COLUMN 1

Line 46, "selfex" should read --self-ex--.

COLUMN 3

Line 2, "CPu" should read --CPU--.
Line 10, "third," should read --third--.

COLUMN 4

Line 53, "example" should read --example,--.

COLUMN 6

Figure 15:
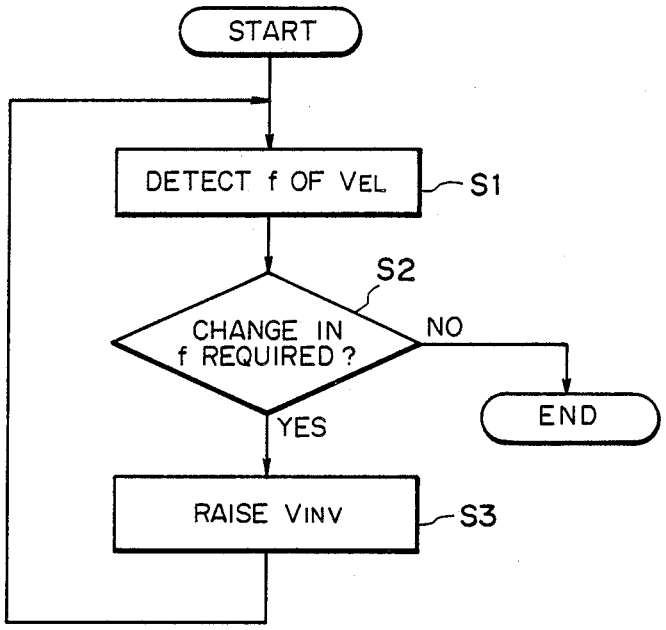
FIG. 15 is a flowchart showing a processing procedure of a CPu in the second embodiment.

Line 16, "FIG. 15" should read --FIG. 15,--.

UNITED STATES PATENT AND TRADEMARK OFFICE

CERTIFICATE OF CORRECTION

PATENT NO. : 4,975,692

DATED : December 4, 1990

INVENTOR(S) : JIRO TATEYAMA

It is certified that error appears in the above-identified patent and that said Letters Patent is hereby corrected as shown below:

COLUMN 7

Line 60, "executed However," should read --executed. However,--.

COLUMN 8

Line 2, "locating," should read --locating--.
Line 11, "adjusted Even" should read --adjusted. Even--.
Line 28, "EMBODIMEBNT]" should read --EMBODIMENT]--.
Line 57, "AC drive voltage VEL" should read --AC drive voltage $V_{EL}$--.

COLUMN 12

Line 4, "which," should read --which--.

Signed and Sealed this

Twenty-third Day of June, 1992

*Attest:*

DOUGLAS B. COMER

*Attesting Officer*

*Acting Commissioner of Patents and Trademarks*